US005716033A

United States Patent [19]

Gibson

[11] Patent Number: 5,716,033

[45] Date of Patent: Feb. 10, 1998

[54] REMOVABLE INTERNAL SUPPORT FOR A FLEXIBLE BAG

[76] Inventor: David B. Gibson, 113 Stratford Square, Port Orange, Fla. 32127

[21] Appl. No.: 686,446

[22] Filed: Jul. 25, 1996

[51] Int. Cl.[6] ..... B65B 67/12

[52] U.S. Cl. ..... 248/95; 248/97; 248/99; 248/152

[58] Field of Search ..... 248/95, 97, 99, 248/174, 152; 24/20 R, 20 EE

[56] References Cited

U.S. PATENT DOCUMENTS

| | | | |
|---|---|---|---|
| 62,560 | 3/1867 | Petty | 24/20 R |
| 119,844 | 10/1871 | Hamlin | 24/20 EE |
| 142,803 | 9/1873 | McMurtry | 24/20 EE |
| 204,525 | 5/1878 | Beard | 24/20 EE |
| 3,822,524 | 7/1974 | Jerpbak . | |
| 4,069,994 | 1/1978 | Wharmby . | |
| 4,457,483 | 7/1984 | Gagne | 248/99 X |
| 4,749,011 | 6/1988 | Rylander | 248/99 X |
| 4,760,982 | 8/1988 | Cooke . | |
| 4,979,547 | 12/1990 | Hoerner | 248/95 X |
| 5,056,679 | 10/1991 | Lonczak | 248/97 X |
| 5,129,609 | 7/1992 | Tobin | 248/97 |
| 5,226,554 | 7/1993 | Dauphinais | 248/97 X |
| 5,271,589 | 12/1993 | Belous | 248/97 |
| 5,292,093 | 3/1994 | Shumake | 248/97 |
| 5,400,989 | 3/1995 | Gaskill | 248/174 X |

*Primary Examiner*—Daniel P. Stodola
*Assistant Examiner*—Gregory J. Strimbu
*Attorney, Agent, or Firm*—Paul S. Rooy

[57] ABSTRACT

A removable internal support for a flexible bag made of flexible material with material memory so that the removable internal support for a flexible bag will attempt to return to a flat configuration when rolled up: Locking apertures constrain the removable internal support for a flexible bag in a rolled-up configuration for insertion into a flexible bag. Rounded corners defined by the intersection of a bottom edge and a top edge with vertical edges, and rounded intersection corners at the intersections of the locking apertures with the vertical edges, prevent the removable internal support for a flexible bag from snagging a flexible bag in which it is installed. The locking apertures are quickly and easily released once the removable internal support for a flexible bag is in position in the flexible bag. After being unlocked from its rolled-up configuration, the material memory inherent in the removable internal support for a flexible bag attempts to return the removable internal support for a flexible bag toward a flat configuration, but is constrained in an approximately cylindrical shape by the flexible bag in which it is installed. The flexible bag may then be filled, and the removable internal support for a flexible bag subsequently removed by simply pulling it out of the bag. The flexible bag may then be tied shut and disposed of in the conventional fashions, and the removable internal support for a flexible bag is ready for re-use.

6 Claims, 4 Drawing Sheets

FIG 4
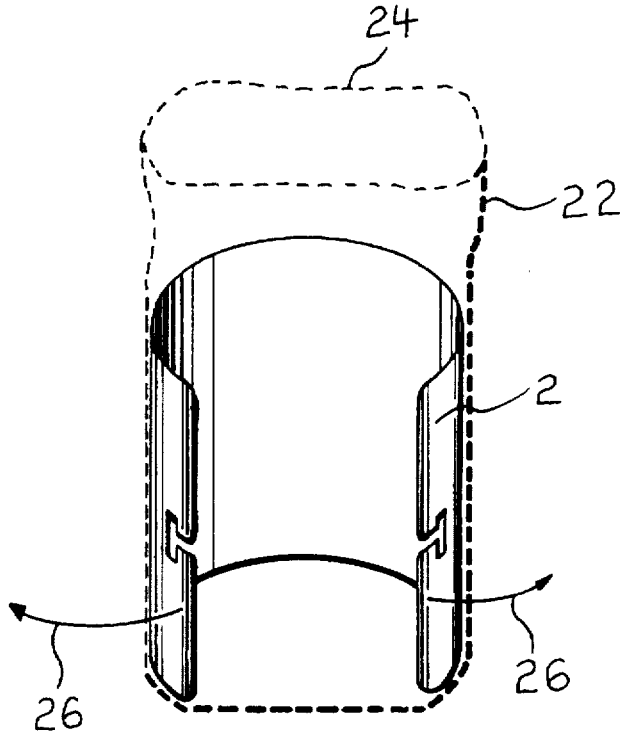
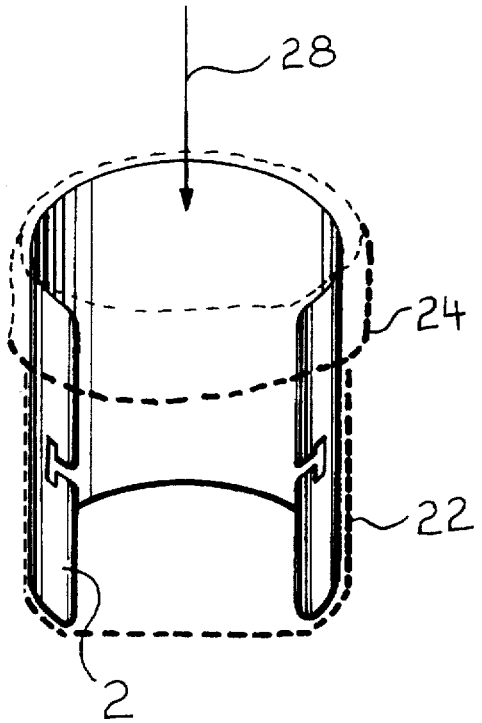
FIG 5

FIG 6
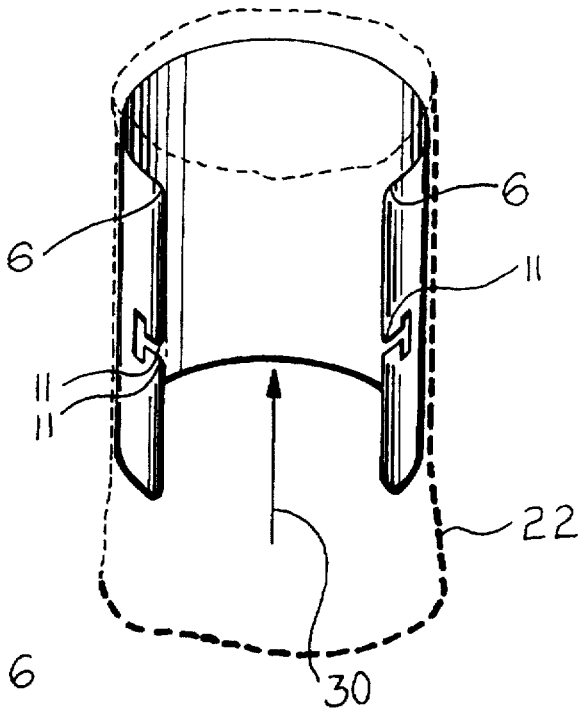
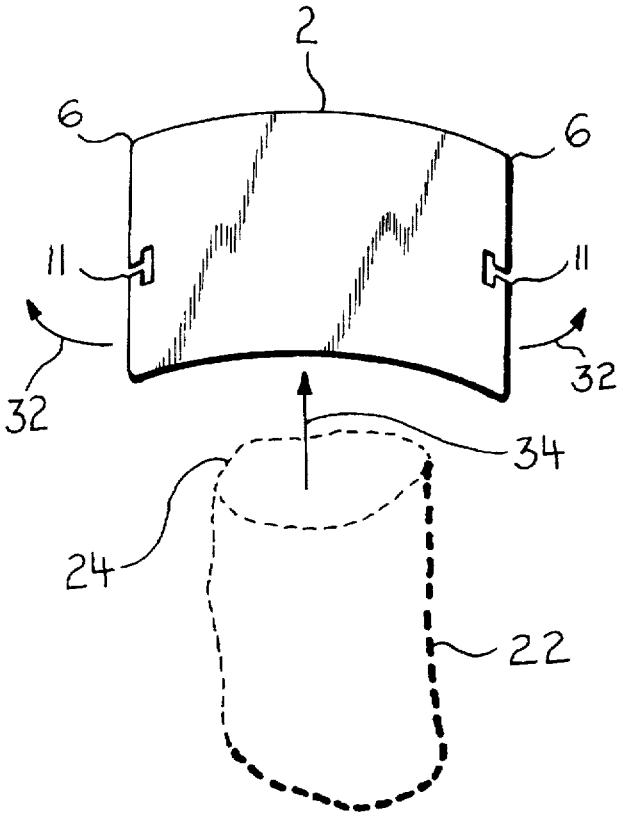
FIG 7

REMOVABLE INTERNAL SUPPORT FOR A FLEXIBLE BAG

BACKGROUND OF THE INVENTION

1. Field of the Invention

This invention relates to flexible bag supports, and in particular to a removable internal support for a flexible bag.

2. Background of the Invention

Flexible bags are used to hold a great variety of items, many of which have the potential of piercing the bag in which they are placed, if the bag is not filled carefully. It is frequently desirable to support a flexible bag which is in the process of being filled, so that the individual filling the bag may use both hands.

One example of a flexible bag which would benefit from a support is the lawn trash bag. These bags are typically made of plastic, and may have a capacity of approximately thirty to sixty gallons. Lawn trash bags are generally filled with leaves, sticks, dead plants, and other trash associated with gardening. One problem associated with their use is the difficulty of filling them. If only one worker is available, he must generally attempt to hold the lawn trash bag open with one hand, while inserting the intended contents with the other. This can be an awkward and time-consuming process. Even if an additional worker is available to hold open the lawn trash bag mouth, the width of the resultant opining is only as wide as the worker's spread fingers-approximately four inches. This opening width may be insufficient to insert much of the trash intended for the bag, such as branches, dead plants, rake-fulls of dead leaves, etc. Another problem associated with manually filling lawn trash bags is that sticks and branches frequently puncture the bag and stick out its sides, thus creating the safety hazard that workers handling the bags may themselves be stuck or scratched.

One solution to these problems has been to provide trash cans to hold bags being filled. This solution works where a permanent trash can installation can be justified, such as the kitchen garbage can. However in many situations, including gardening, there may not be a convenient place to leave a garbage can because the lawn trash is located in a number of places, spread out over a yard or garden. In these settings, it is more convenient to use a support which is lighter and more easily transported than a garbage can.

An additional problem associated with the use of garbage cans to support lawn trash bags is that these large bags tend to seal themselves within a garbage can, and to draw a vacuum when removed. This vacuum makes it difficult to remove the lawn trash bag from a garbage can, and may even cause the bag to tear, spilling its contents.

Existing Designs

A number of designs have been patented for internal bag supports intended to hold a flexible bag open. These internal bag supports were generally made from flat sheets of flexible, springy material. In use, the internal bag support was rolled up and inserted into a bag, and then allowed to spring open. The mechanical memory inherent in the support material would urge the support to resume its originally flat disposition, and the flexible bag in which it was installed would constrain the support into a roughly cylindrical shape within the bag. One problem associated with these designs was that the support had to be held in a rolled-up configuration against the inherent springiness of the support material in order to insert the support into a bag. U.S. Pat. No. 4,749,011 taught the use of a belt to keep the support rolled-up during insertion. This design suffered from a number of drawbacks. Attaching a belt around a rolled up support, and then removing same after insertion, was time-consuming and laborious. In addition, the danger existed that the belt could be lost when not secured around the support. U.S. Pat. No. 3,822,524 disclosed a number of headed stud fasteners to retain a support in a rolled-up configuration for insertion into a flexible bag. Attaching these fasteners would be time-consuming. The danger also existed in this design that the numerous small fasteners could be lost when not in use.

U.S. Pat. No. 4,457,483 taught fasteners integral to the support itself. These fasteners comprised snap-like knobs which were formed out of the support material, and corresponding openings sized to frictionally admit the knobs. This fastening solution required the expensive production step of molding snaps into the support. This approach was also cumbersome to use. In the preferred embodiment, three knobs had to be individually lined up and snapped into their corresponding opening. Accomplishing this fastening procedure required three separate two-handed operations. In addition, once the support was inserted into a bag, three additional two-handed operations were required to unsnap the three knobs. Finally, with use, the material from which the knobs and openings were made could become worn, and the snaps would no longer hold the support rolled-up for insertion.

U.S. Pat. No. 5,226,554 taught a series of semi-circular "C" cuts which apparently held the support rolled-up. As disclosed in the drawings, these "C" cuts held only one corner of the support, and appeared to provide only a precarious lock.

SUMMARY OF THE INVENTION

Accordingly, it is an object of the present invention to provide a removable internal support for a flexible bag which is capable of holding a flexible bag mouth wide open. Design features allowing this object to be accomplished include a sheet manufactured of springy material with sufficient memory to attempt to return to its original shape. Advantages associated with the accomplishment of this object include easier and faster flexible bag filling. It is another object of the present invention to provide a removable internal support for a flexible bag which is capable of supporting a flexible bag in a shape approximating that of a filled bag. Design features allowing this object to be accomplished include a sheet manufactured of springy material with sufficient memory to attempt to return to its original shape. Benefits associated with the accomplishment of this object include easier and faster flexible bag filling. It is another object of this invention to provide a removable internal support for a flexible bag which prevents most sharp flexible bag contents from piercing the flexible bag during the filling process. Design features enabling the accomplishment of this object include a sheet manufactured of smooth, strong material which supports a flexible bag being filled. An advantage associated with the realization of this object is increased safety for workers filling the flexible bag.

It is still another object of this invention to provide a removable internal support for a flexible bag which is easily locked into a rolled-up configuration, and easily unlocked from a rolled-up configuration. Design features allowing this object to be achieved include a slot disposed on each of two vertical edges, and a cross slot communicating with each slot. Benefits associated with reaching this objective include quick and easy one-handed support locking and unlocking, reliable positive locking, and the cost savings associated with integral locks which do not require a separate manufacturing step to form. In addition, the danger of lost fasteners is avoided by the instant invention's incorporation of locks integral to the sheet.

It is a further object of this invention to provide a removable internal support for a flexible bag which is easily transported. Features permitting this object to be accomplished include a simple, integral, single sheet construction. Benefits associated with the achievement of this object include ease of use and faster bag filling.

It is still another object of this invention to provide a removable internal support for a flexible bag which prevents a vacuum from being pulled when the support is disengaged from the flexible bag. Design features allowing this object to be achieved include a sheet rolled into a bottomless "C" shape when installed in a flexible bag. Benefits associated with reaching this objective include increased ease of use and less chance of tearing the flexible bag.

BRIEF DESCRIPTION OF THE DRAWINGS

The invention, together with the other objects, features, aspects and advantages thereof will be more clearly understood from the following in conjunction with the accompanying drawings. Four sheets of drawings are provided. Sheet one contains FIGS. 1 and 2. Sheet two contains FIG. 3. Sheet three contains FIGS. 4 and 5. Sheet four contains FIGS. 6 and 7.

FIG. 4 is a front isometric view of a removable internal support for a flexible bag installed in a flexible bag.

FIG. 5 is a front isometric view of a removable internal support for a flexible bag installed in the bottom of a flexible bag, ready for use.

FIG. 6 is a front isometric view of a removable internal support for a flexible bag installed in the upper part of a flexible bag, ready for use.

FIG. 7 is a front isometric view of a removable internal support for a flexible bag which has just been removed from the flexible bag in which it was installed.

DETAILED DESCRIPTION OF THE PREFERRED EMBODIMENT

Figure 1:
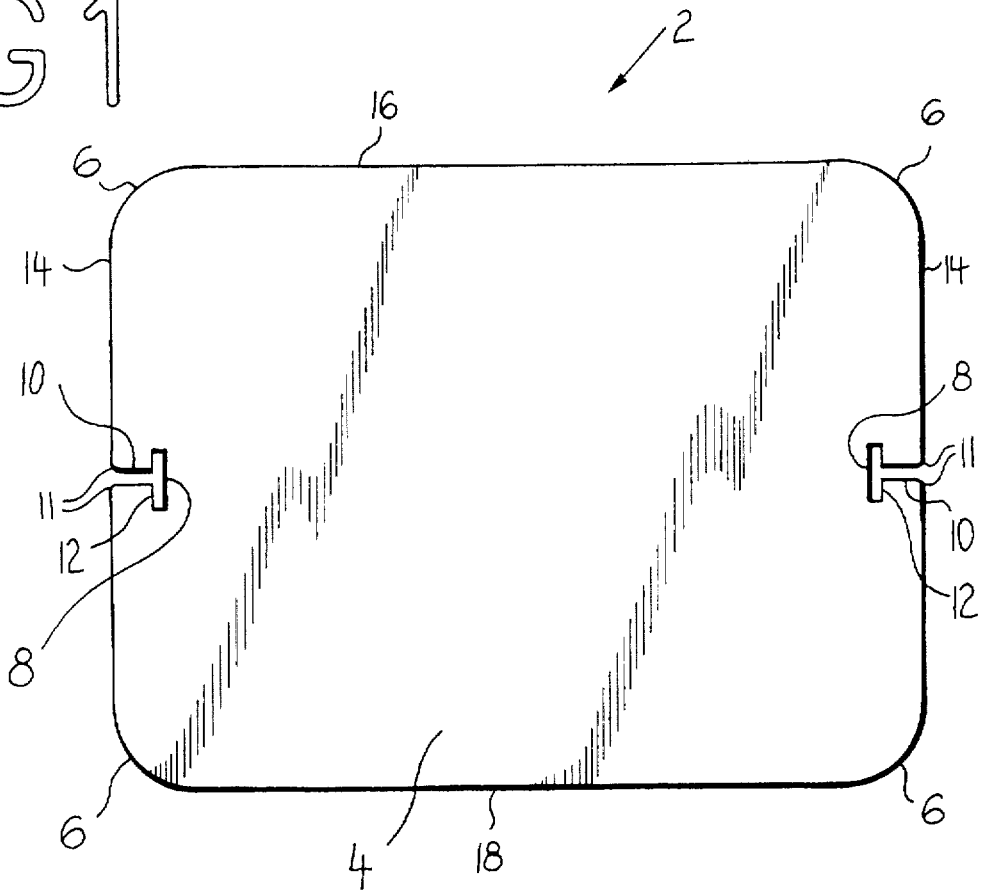
FIG. 1 is a front view of a removable internal support for a flexible bag in the flat configuration.

FIG. 1 is a front view of removable internal support for a flexible bag 2 in the flat configuration. This is the natural shape to which removable internal support for a flexible bag 2 will attempt to return, due to the material memory of which it is constructed. Removable internal support for a flexible bag 2 is made of a flat sheet 4 of appropriate material, such as low density polypropylene, plastic, etc. Removable internal support for a flexible bag 2 comprises two vertical edges 14. A locking aperture 8 is disposed adjacent each vertical edge 14. Each locking aperture 8 comprises a slot 10 disposed approximately perpendicular to its adjacent vertical edge. Sheet 4 corners at the intersection of slots 10 and vertical edges 14 define rounded intersection corners 11. Rounded intersection corners 11 are rounded to help prevent a flexible bag 22 from getting caught on rounded intersection corners 11. Each locking aperture 8 further comprises a cross slot 12 disposed approximately perpendicular to, and communicating with, a slot 10.

Removable internal support for a flexible bag 2 further comprises top edge 16 and bottom edge 18. The intersections of top edge 16 and bottom edge 18 with vertical edges 14 define rounded corners 6. Rounded corners 6 are rounded to help prevent a flexible bag 22 from getting caught on rounded corners 6.

Figure 2:
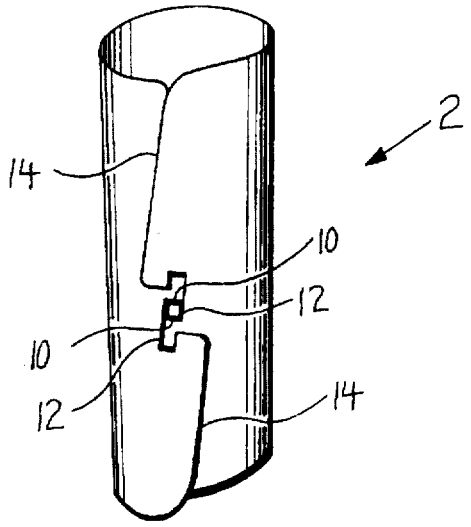
FIG. 2 is a front isometric view of a removable internal support for a flexible bag in the rolled-up configuration.

FIG. 2 is a front isometric view of a removable internal support for a flexible bag 2 in the rolled-up configuration, ready to be installed into a flexible bag 22. Removable internal support for a flexible bag 2 is locked into the rolled-up configuration by rolling removable internal support for a flexible bag 2 into a cylindrical shape, as illustrated in FIG. 2, and then inserting one locking aperture 8 into the other locking aperture 8. Vertical edges 14 are then displaced longitudinally relative to each other until cross slots 12 interlock, thereby locking removable internal support for a flexible bag 2 in the rolled-up configuration. Removable internal support for a flexible bag 2 is unrolled by simply displacing vertical edges 14 relative to each other until cross slots 12 are no longer interlocked. At that point, locking apertures 8 mutually disengage, and the material memory of sheet 4 urges removable internal support for a flexible bag 2 into the flat configuration illustrated in FIG. 1.

Figure 3:
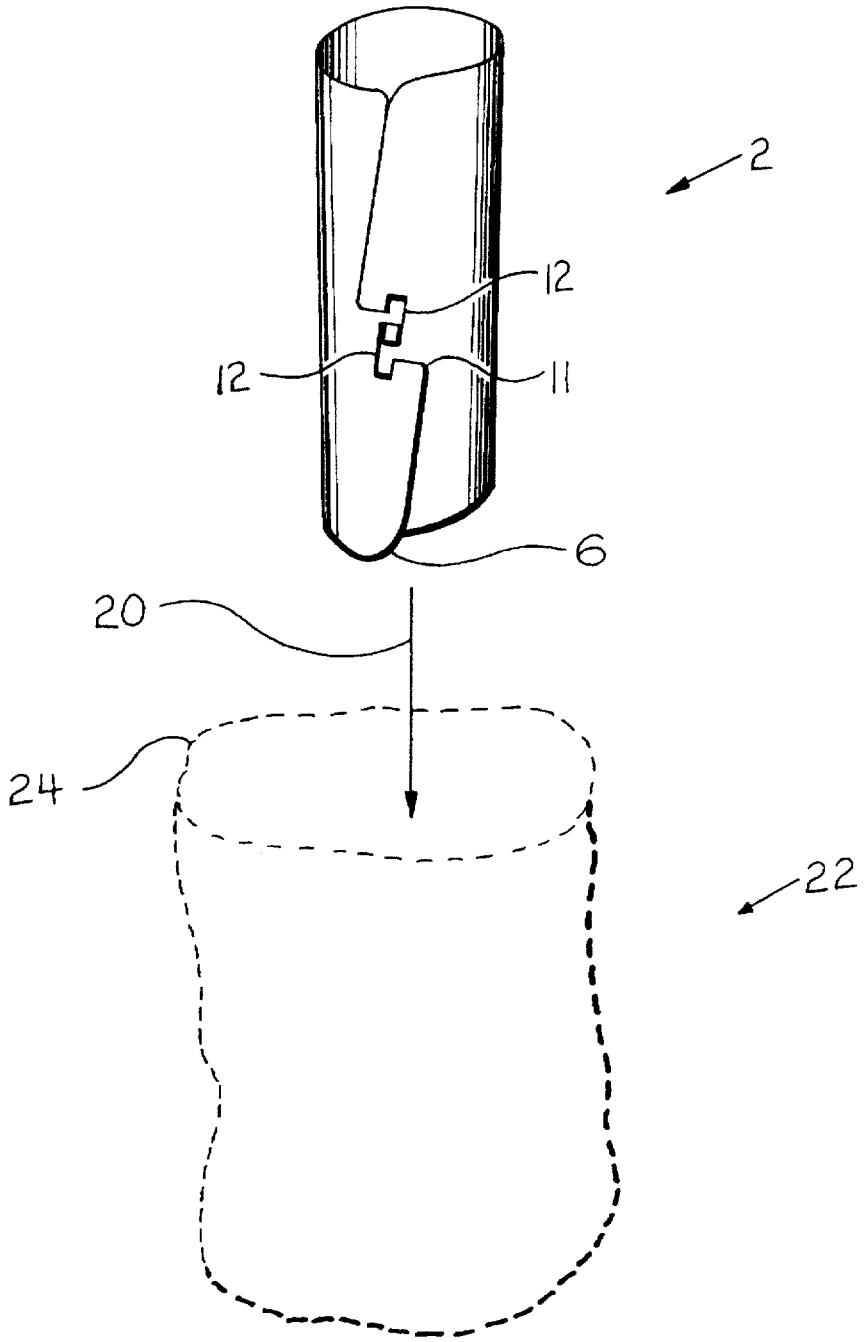
FIG. 3 is a front isometric view of a removable internal support for a flexible bag in the rolled-up configuration in the process of being inserted into a flexible bag.

FIG. 3 is a front isometric view of removable internal support for a flexible bag 2 in the rolled-up configuration, in the process of being inserted through flexible bag mouth 24 into flexible bag 22, as indicated by arrow 20. Rounded corners 6 and rounded intersection corners 11 help prevent removable internal support for a flexible bag 2 from snagging flexible bag 22 during insertion. Once inserted into flexible bag 22, removable internal support for a flexible bag 2 is unlocked by displacing vertical edges 14 relative to each other until cross slots 12 are no longer interlocked. At that point, locking apertures 8 mutually disengage, and the material memory of sheet 4 urges removable internal support for a flexible bag 2 towards the flat configuration, as indicated by arrows 26 in FIG. 4.

FIG. 4 is a front isometric view of a removable internal support for a flexible bag 2 installed in a flexible bag. Flexible bag 22 constrains removable internal support for a flexible bag 2 into a roughly cylindrical shape, as illustrated in FIGS. 4, 5 and 6. In this manner, removable internal support for a flexible bag 2 holds flexible bag 22 in approximately the same shape as it would assume were it filled, with flexible bag mouth 24 in a wide-open position.

FIG. 5 is a front isometric view of a removable internal support for a flexible bag 2 installed in the bottom of a flexible bag 22, ready for use. Flexible bag mouth 24 has been folded down so that the material with which flexible bag 22 is to be filled may be easily and quickly inserted, as indicated by arrow 28.

In the case of taller bags, removable internal support for a flexible bag 2 may be moved upwards within flexible bag 22 as indicated by arrow 30 in FIG. 6, in order to continue filling the upper part of flexible bag 22. Rounded corers 6 and rounded intersection corers 11 help prevent removable internal support for a flexible bag 2 from snagging flexible bag 22 as removable internal support for a flexible bag 2 is moved upwards. FIG. 6 is a front isometric view of removable internal support for a flexible bag 2 installed in the upper part of flexible bag 22. Flexible bag 22 may now continue to be filled.

After flexible bag 22 has been filled to the desired level, removable internal support for a flexible bag 2 is removed from flexible bag 22 by simply pulling it out, as indicated by arrow 34 in FIG. 7. Rounded corners 6 and rounded intersection corers 11 help prevent removable internal support for a flexible bag 2 from snagging flexible bag 22 as removable internal support for a flexible bag 2 is removed. FIG. 7 is a front isometric view of a removable internal support for a flexible bag 2 which has just been removed from the flexible bag 22 in which it was installed. The material memory inherent in the material from which removable internal support for a flexible bag 2 is made urges removable internal support for a flexible bag toward the flat configuration, as indicated by arrows 32. At this point, flexible bag 22 may be tied shut and disposed of in the conventional fashions, and removable internal support for a flexible bag 2 is ready for re-use.

While a preferred embodiment of the invention has been illustrated herein, it is to be understood that changes and variations may be made by those skilled in the art without departing from the spirit of the appending claims.

DRAWING ITEM INDEX

2 removable internal support for a flexible bag
4 sheet
6 rounded corner
8 locking aperture
10 slot
11 rounded intersection corner
12 cross slot
14 vertical edge
16 top edge
18 bottom edge
20 arrow
22 flexible bag
24 flexible bag mouth
26 arrow
28 arrow
30 arrow
32 arrow
34 arrow

I claim:

1. A removable internal support for a flexible bag comprising a sheet made of flexible, resilient material, said sheet being defined on two sides by vertical edges, and a locking aperture respectively disposed on each said vertical edge, each said locking aperture comprising a slot communicating with a cross slot, said locking aperture being T-shaped.

2. The removable internal support for a flexible bag of claim 1 wherein each said slot is disposed approximately perpendicular to the respective vertical edge, and each said cross slot is disposed approximately perpendicular to, and communicates with, the respective slot.

3. The removable internal support for a flexible bag of claim 2 wherein said sheet further comprises a top edge and a bottom edge, intersections of said top edge and said bottom edge with said vertical edges defining rounded corners.

4. The removable internal support for a flexible bag of claim 3 wherein an intersection of each said slot and said respective vertical edge define rounded intersection corners.

5. A removable internal support for a flexible bag comprising a sheet of flexible material, vertical edges on said sheet, locking apertures respectively disposed on said vertical edges, each said locking aperture comprising a slot communicating with a cross slot, said cross slot comprising a first cross slot end and a second cross slot end, said slot communicating with said cross slot approximately midway between said first cross slot end and said second cross slot end, whereby said removable internal support for a flexible bag may be constrained in a rolled-up configuration either by engaging said first cross slot end of one of said locking apertures and said second cross slot end of the other of said locking apertures, or in the alternative, by engaging said second cross slot end of one of said locking apertures and said first cross slot end of the other of said locking apertures.

6. A removable internal support for a flexible bag comprising a sheet of flexible, resilient material, vertical edges on said sheet, locking apertures respectively disposed on said vertical edges, each said locking aperture comprising a slot, a first lobe, and a second lobe, said first and second lobes projecting from a base of said slot, said slot base being disposed at an end of said slot opposite said respective vertical side, whereby said removable internal support for a flexible bag may be constrained in a rolled-up configuration either by engaging said first lobe of one of said locking apertures and said second lobe of the other of said locking apertures, or in the alternative, by engaging said second lobe of one of said locking apertures and said first lobe of the other of said locking apertures.

* * * * *